US009169100B2

(12) United States Patent
Stojanovski et al.

(10) Patent No.: US 9,169,100 B2
(45) Date of Patent: Oct. 27, 2015

(54) SYSTEMS AND METHODS FOR IMPLEMENTING A UNIQUE VARIABLE STACKING SURFACE FOR SET COMPILING IN IMAGE FORMING DEVICES

(71) Applicant: XEROX Corporation, Norwalk, CT (US)

(72) Inventors: Billy T. Stojanovski, Penfield, NY (US); Gerald Roy Curry, Lima, NY (US); Thomas Crofton Hatch, Williamson, NY (US); Michael J. Linder, Walworth, NY (US); Todd Maurice Uthman, Rochester, NY (US); Donald R. Fess, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 50 days.

(21) Appl. No.: 14/053,686

(22) Filed: Oct. 15, 2013

(65) Prior Publication Data

US 2015/0102553 A1 Apr. 16, 2015

(51) Int. Cl.
*B65H 29/42* (2006.01)

(52) U.S. Cl.
CPC ..... *B65H 29/42* (2013.01); *B65H 2301/4223* (2013.01); *B65H 2404/663* (2013.01); *B65H 2405/1111* (2013.01)

(58) Field of Classification Search
CPC .. B65H 3/28; B65H 29/42; B65H 2301/4223; B65H 2404/663; B65H 2405/1111; B65H 2405/1112
USPC ..... 271/179
See application file for complete search history.

(56) References Cited

U.S. PATENT DOCUMENTS

| | | | | | |
|---|---|---|---|---|---|
| 2,970,836 | A * | 2/1961 | Smith | 271/179 |
| 3,995,851 | A * | 12/1976 | Casper | 271/179 |
| 4,270,747 | A * | 6/1981 | Templeton | 271/179 |
| 4,547,114 | A * | 10/1985 | Watrous et al. | 414/793.9 |
| 4,573,676 | A * | 3/1986 | Miyamoto et al. | 271/179 |
| 5,765,827 | A * | 6/1998 | Gillmann | 271/300 |
| 5,810,352 | A * | 9/1998 | Kobayashi et al. | 271/293 |
| 5,816,570 | A * | 10/1998 | Paradis et al. | 271/179 |
| 5,845,901 | A * | 12/1998 | Coombs et al. | 271/293 |
| 6,095,516 | A * | 8/2000 | Sawano et al. | 271/207 |
| 6,984,098 | B2 * | 1/2006 | Tsukahara et al. | 414/794.2 |
| 8,434,756 | B2 * | 5/2013 | Brewer | 271/148 |
| 8,636,280 | B2 * | 1/2014 | Dorrie et al. | 271/179 |
| 9,027,922 | B2 * | 5/2015 | Stojanovski et al. | 271/179 |
| 2015/0091248 | A1 * | 4/2015 | Herrmann | 271/314 |

* cited by examiner

*Primary Examiner* — Jeremy R Severson
(74) *Attorney, Agent, or Firm* — Ronald E. Prass, Jr.; Prass LLP

(57) ABSTRACT

A system and method are provided for improving stack integrity for image receiving media substrates in a compiler tray in an image forming device by supplementing the structure of the compiler tray with a pair of auger components configured with a bottom surface that, in conjunction with a stepped support structure in the compiler tray, applies a mechanical leveling force to reduce or otherwise eliminate detrimental effects associated with substrate curl or uneven set build-up in the compiler tray. The vertical compiler components provide an accommodation for localized thickness build-up in compiled image receiving media substrates by one or more processing or post-processing steps. The auger components provide a mechanical pressing force that is intended to level a top surface of the compiled substrates with the configuration of the compiler tray providing the relief area necessary for the accommodation.

20 Claims, 6 Drawing Sheets

SYSTEMS AND METHODS FOR IMPLEMENTING A UNIQUE VARIABLE STACKING SURFACE FOR SET COMPILING IN IMAGE FORMING DEVICES

This application is related to U.S. patent application Ser. No. 14/039,045, entitled "Systems and Methods For Implementing An Auger-Based Transport Mechanism For Vertical Transport Of Image Receiving Media In Image Forming Systems," to Herrmann, filed on Sep. 27, 2013, and U.S. patent application Ser. No. 14/053,664, entitled "Systems And Methods For Implementing A Unique Planar Stacking Surface For Set Compiling In Image Forming Devices," filed on Oct. 15, 2013, the same day as this application. The disclosures of the above-identified references are hereby incorporated by reference herein in their entireties.

BACKGROUND

1. Field of Disclosed Subject Matter

This disclosure relates to systems and methods for improving stack integrity for image receiving media substrates in a compiler tray in an image forming device by supplementing the structure of the compiler tray with a pair of auger components configured with a bottom surface that, in conjunction with a stepped support structure in the compiler tray, applies a mechanical leveling force to reduce or otherwise eliminate detrimental effects associated with substrate curl or uneven set build-up in the compiler tray.

2. Related Art

Many modern image forming devices are comprised of myriad discrete component sub-systems. These discrete component sub-systems include (1) image receiving media supply components at an input end of the image forming device, (2) pre-processing and/or conditioning components for preparing surfaces of the image receiving media substrates to receive marking material to form images, (3) a marking material delivery component for depositing marking material on the surfaces of the image receiving media substrates to form the images according to input or read image signals, (4) fusing/finishing components for fixing the deposited marking material on the image receiving media substrates, and (5) post-processing devices for carrying out certain post processing tasks including compilers for collating the image receiving media substrates as sets comprising multi-page finished documents, for example, for stapling or otherwise binding the multi-page finished documents.

The individual component sub-systems are generally interconnected by a series of increasingly intricate image receiving media substrate transport sub-systems, paths and/or components. The image receiving media transport sub-systems, paths and/or components are generally designed and implemented in particular office-sized image forming devices in a manner that manages a size footprint for the image forming devices while not specifically limiting the transport requirements from an output of one component sub-system to an input of another component sub-system.

At an end of the processing scheme, the form and function of the image receiving media transport sub-systems, paths and/or components often become somewhat more narrowly defined. The print job is generally completed with individual sheets of image receiving media substrates, with the images formed and fixed thereon, being collected in sets according to instructions for completing individual print jobs. Individual image receiving media substrates and/or compiled sets of image receiving media substrates are collected and/or assembled in differing configurations of compiler trays associated with one or more of the post-processing sub-systems. Manipulation of the individual image receiving media substrates, or of the sets of image receiving media substrates, at that point in the processing of the documents responsive to the directed print job can be particularly intricate. There is often a need to ensure that the sets of image receiving media substrates are fairly precisely handled, stacked, and/or registered in order to facilitate one or more post-processing or finishing processes including, for example, stapling or binding.

The manipulations associated with aligning (registering) individual sheets into sets are broadly referred to as, and are generally understood by those of skill in the art to involve, functions of stacking and tamping the individual sheets of image receiving media substrates into precise alignment in the sets. Stacking often occurs against a static edge alignment body portion at an output of the processing or post-processing devices to provide longitudinal alignment of the individual sheets of image receiving media substrates with respect to a process direction, stacking being generally considered to be a passive process. Tamping generally refers to a most often active alignment component in which paddles or other devices may be employed on any, but most often, lateral sides of a set of image receiving media substrates to align the set in a direction orthogonal to the process direction.

Certain currently-fielded systems may be configured with what may generally be described as vertical compiler sub-systems. FIG. 1 illustrates a simple schematic representation of a side view of an exemplary system 100 incorporating a commonly-implemented vertical compiler. FIG. 2 illustrates a simple schematic representation of a top plan view of an exemplary system 100 incorporating the same commonly-implemented vertical compile shown in FIG. 1. As shown in FIGS. 1 and 2, individual sheets of image receiving media substrates 130 exit an imaging system processing/post-processing device 110 at an exit/ejection port 115 and are individually deposited in an output (compiler) tray 120.

A "bottom" or platform of the output (compiler) tray 120 may consist of a plurality of longitudinally-arranged image receiving media substrate supports that extend in the process (longitudinal) direction of the image receiving media substrates 130. The image receiving media substrates 130 rest on the substrate supports and are generally manually recoverable from the substrate supports.

In exemplary systems such as that shown in FIGS. 1 and 2, vertical set compiling may occur in one or more stages as follows. Individual image receiving medium substrates 130 may be dropped in stages from the output (compiler) tray 120, acting as a temporary compiler. This dropping may be effected, by laterally-opposing motions, i.e., orthogonal to the process direction, of the plurality of longitudinal image receiving media substrate supports (or arms) toward opposed lateral edges of the output (compiler) tray 120, displacing the substrate supports from under the image receiving media substrates 130. As a result of the linear movement of the plurality of longitudinal image receiving media substrate supports, each of the image receiving media substrates 130 drops down to an image receiving medium set receiving platform, or an output set collection platform component 150.

The image receiving media substrates 130 may be collected as a set 140 on the output set collection platform component 150. The output set collection platform component 150 may, in turn, be comprised of at least a pair of compiler shutters 152/154. Each sheet of the image receiving media substrates 130 in the set is dropped in a similar fashion to create the set 140 of image receiving media substrates on the compiler shutters 152/154. When the set 140 of image receiving media substrates is complete and properly registered, and optionally, for example, bound or stapled, the set 140 of image receiving media substrates is then dropped onto a stack of previously-dropped sets 170 of image receiving media substrates, or directly onto some manner of set output transport path 160 to be moved in a process direction B from a first stack position to a second stack position 180 and beyond.

The above-described dropping function is currently undertaken in commonly-implemented vertical compiler sub-systems by rapid cycling of the compiler shutters 152/154 in opening and then closing in mechanically opposing motions.

SUMMARY OF THE DISCLOSED EMBODIMENTS

Both of the above-described drop functions will often tend to introduce variation in set registration in the first individual sheet drop stage and the set-to-set (stack) registration in the second drop stage. U.S. patent application Ser. No. 14/039,045, entitled "Systems and Methods For Implementing An Auger-Based Transport Mechanism For Vertical Transport Of Image Receiving Media In Image Forming Systems," to Herrmann, the disclosure of which is hereby incorporated by reference herein in its entirety describes an auger-based vertical transport system for uniquely addressing shortfalls in conventional vertical transport components.

Difficulties may arise in the compiling of output collections of individual image receiving media substrates, and moreover in the collection of multiple sets of image receiving media substrates in certain currently-fielded image forming devices and image forming systems, particularly for use in an office environment. The image forming and finishing processes induce a curl to individually-processed image receiving media substrates based on a variation in the effect of local environmental factors on, for example, printed and non-printed portions of the individual image receiving media substrates. Separately, inclusion of separate stapling and/or other binding components, tend to induce locally higher areas in stacks of similarly bound or stapled sets of image receiving media substrates. For example, small stapled sets (<20 sheets) of image receiving media substrates build-up on an accumulated stack of sets below, and the increased thickness due to the stapling can eventually build to a point where the stack interferes with the compiling sets, causing further height differential.

Attempts to address these difficulties fall short of meeting current requirements for increased precision in the in-set and set-to-set registration processes, particularly as operating and processing speeds for completing print jobs in the involved image forming devices continue to increase. Conventional shutter-based configurations are considered unable to work effectively in certain devices due to productions speeds, e.g., at upwards to 157 ppm.

It would be advantageous in view of the above-noted image receiving medium handling difficulties, particularly arising from increasingly high speed document preparation requirements, to optimize movement of vertically-moved image receiving media substrates and sets of image receiving media substrates in a manner that reduces and/or slows overall mechanical movement, and particularly high speed reciprocating mechanical movement, of certain components in the vertically-configured image receiving media transport paths. It would be further advantageous to implement innovations in vertical compiler components and/or sub-systems that may optimize configurations of compiler trays and take advantage of certain unique aspects of employment of auger-based vertical movement components to provide a comparatively easily-implementable technique by which to "flatten" a top of the compiled substrates or substrate sets in support of improved image receiving media substrate handling in image forming devices and systems.

Exemplary embodiments of the systems and methods according to this disclosure may provide additional structures to facilitate vertical movement and flattening of individual substrates and sets of substrates in an output compiler tray.

Exemplary embodiments may provide a particularly-configured pair of auger components with unique bottom mechanical surfaces that cooperatively engage collected individual substrates and/or sets of substrates to substantially force any curl or other physical build-up to be accommodated in a particularly configured gutter portion in a receiving compiler tray.

Exemplary embodiments may provide the pair of particularly-configured augers to both move the sheets of image receiving media or compiled completed sets vertically downward in the image receiving media substrate transport system, and then to compress a top face of the delivered image receiving media substrates or sets of image receiving media substrates in an accommodatingly-configured compiler tray.

Exemplary embodiments may refine and specifically employ particular configurations of other related auger support/transport systems to a particular configuration and function. Auger systems, such as those described and depicted in the related 045 application, employ traditional helical auger shapes. A spiral surface of the related augers may engage different width sheets at different points along the blades of the augers. In embodiments, the disclosed concept modifies those configurations to particularly add a cooperating receiver surface of a compiler tray in a manner to accommodate local elevations or differing thicknesses of individual image receiving media substrates and compiled sets of image receiving media substrates so as to effectively mechanically flatten a top surface the individual image receiving media substrates and/or compiled sets of image receiving media substrates.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for improving stack integrity with regard to one or more sets of image receiving media substrates assembled in a compiler tray in an image forming device by supplementing the structure of the compiler tray with a pair of auger components configured with a bottom surface that, in conjunction with a stepped support structure in the compiler tray, the auger components applying a mechanical leveling force to reduce or otherwise eliminate detrimental effects associated with substrate curl or uneven physical set build-up in the compiler tray, will be described, in detail, with reference to the following drawings, in which.

DETAILED DESCRIPTION OF THE DISCLOSED EMBODIMENTS

Figure 1:
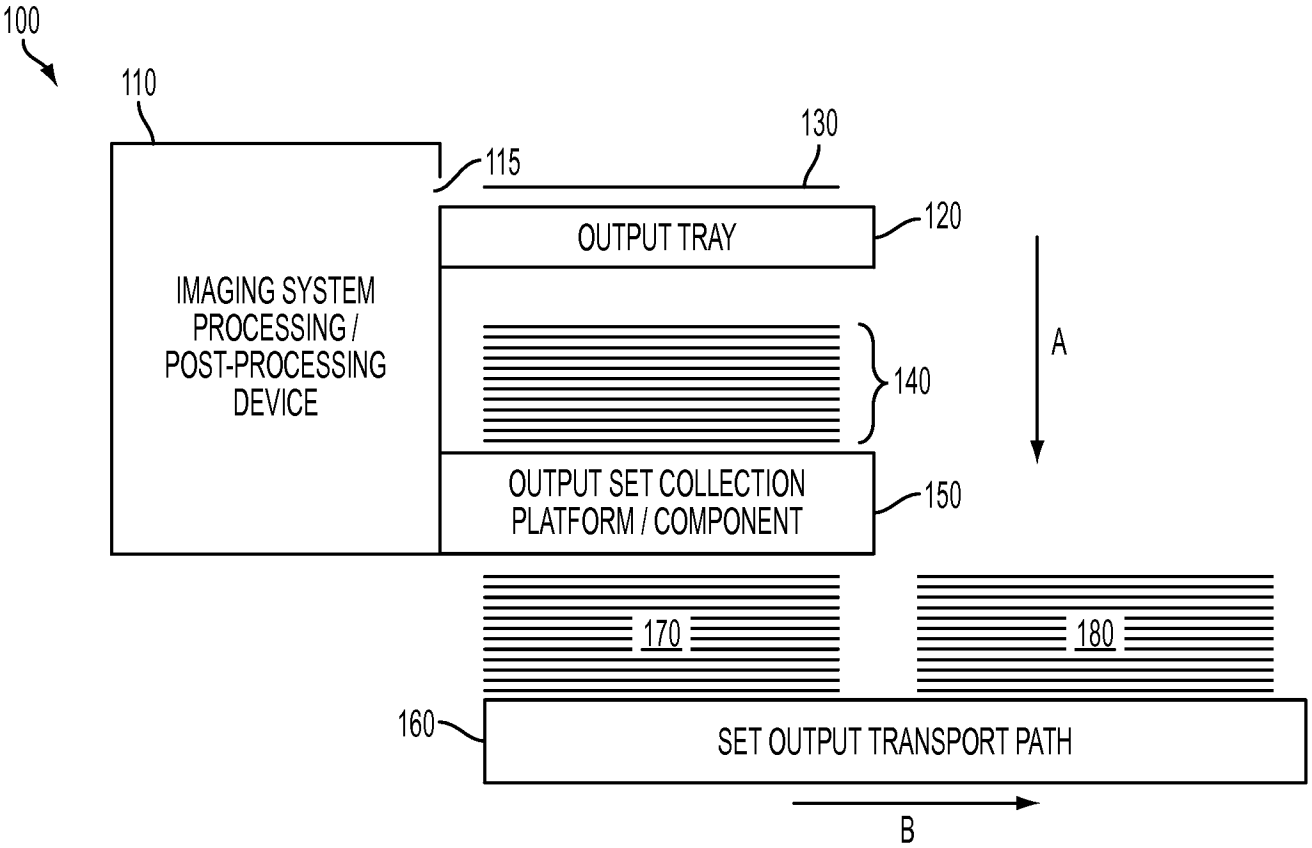
FIG. 1 RELATED ART
FIG. 1 illustrates a simple schematic representation of a side view of an exemplary related art system incorporating a commonly-implemented vertical compiler setup that may be improved upon using the systems and methods according to this disclosure.
Figure 2:
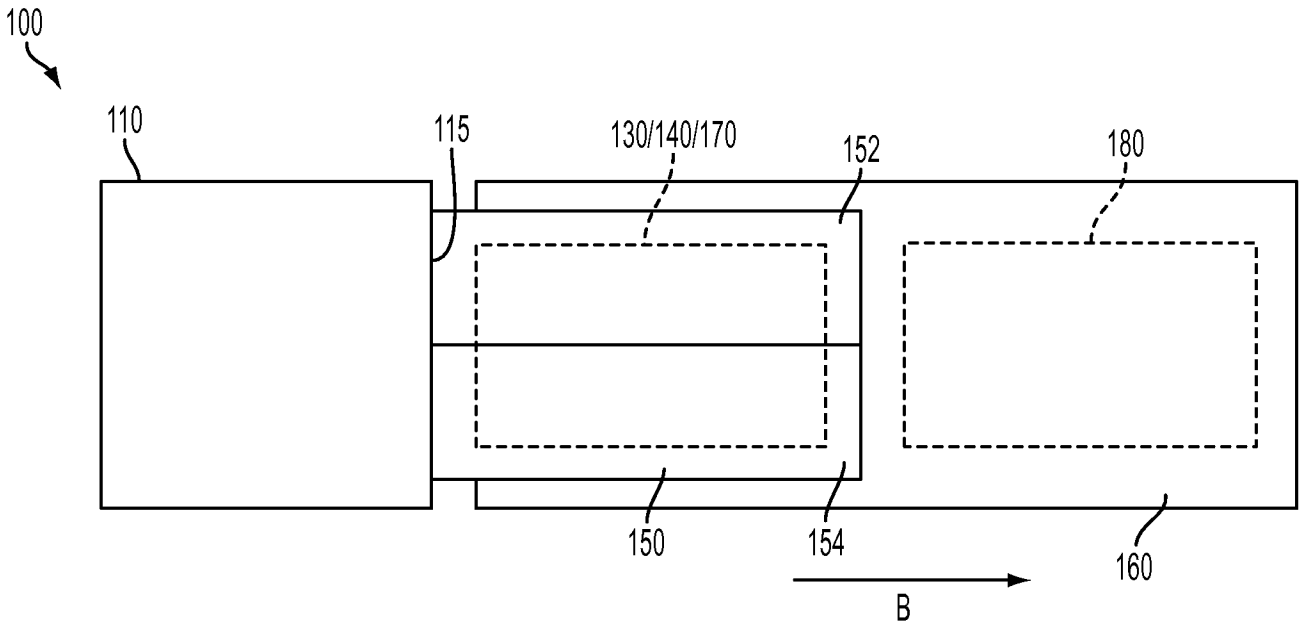
FIG. 2 RELATED ART
FIG. 2 illustrates a simple schematic representation of a top plan view of the exemplary related art system incorporating the same commonly-implemented vertical compiler setup shown in FIG. 1.

The systems and methods for improving stack integrity with regard to one or more sets of image receiving media substrates assembled in a compiler tray in an image forming device by supplementing the structure of the compiler tray with a pair of auger components configured with a bottom surface that, in conjunction with a stepped support structure in the compiler tray, applies a mechanical leveling force to reduce or otherwise eliminate detrimental effects associated with substrate curl or uneven set build-up in the compiler tray according to this disclosure, will generally refer to this specific utility, configuration or function for those systems and methods. Exemplary embodiments described and depicted in this disclosure should not be interpreted as being specifically limited to any particular configuration of the described elements except insofar as individual auger elements as disclosed and depicted will provide the disclosed flattening function in cooperation with a particularly-configured receiver tray incorporating, for example, one of a fixed or variable structure for a stepped or ramped receiver portion, generically referred to below as a "gutter" for simplicity and ease of understanding. Further, the disclosed exemplary embodiments should not be interpreted as being specifically limited to any particular limiting intended use, including any particular functioning or operation of a processing, post-processing or other component device in an image forming system in which elements of the disclosed auger-based transport system or mechanical auger vertical compiler device may be advantageously employed.

Specific reference to, for example, various configurations of image forming systems and component devices within those systems, including post-processors and/or compilers, as those concepts and related terms are captured and used throughout this disclosure, should not be considered as limiting those concepts or terms to any particular configuration of the respective devices, system configurations or individual elements. The subject matter of this disclosure is intended to broadly encompass systems, devices, schemes and elements that may involve image forming and finishing operations, as those operations would be familiar to those of skill in the art. The disclosed concepts are particularly adapted to providing one or more auger-based vertical compiler systems in appropriate image receiving media transport paths between individual component devices associated with image forming and finishing in a complex image forming system.

The disclosed embodiments may specifically address shortfalls in conventional compilers in which compiled stack integrity is often compromised because individual substrate curl or set compiling (and binding) techniques may introduce some measurable distinction between significant portions of individual image receiving media substrates and sets of compiled image receiving media substrates and certain minimal and localized raised portions of the substrates or sets of substrates.

The disclosed embodiments may reduce or substantially eliminate an uneven top layer profile to compiled sheets of image receiving media substrates or compiled sets of image receiving media substrates in a vertically-oriented compiler including a particularly-configured cooperating compiler (or substrate receiving) tray. In embodiments, local vertical protrusions of the image receiving media substrates, or sets of image receiving media substrates, above a nominal planar level established for a substantial overall area for the image receiving media substrates, or sets of image receiving media substrates, may be mechanically leveled through cooperation of a particular interaction of a pair of auger components in a vertical compiler structure with a particularly-configured receiver or compiler tray. In operation, as will be particularly shown below with reference to FIGS. 3-5, the auger components act in particular cooperation with a complementary configuration of a receiver tray to serve to effect a vertical transport and flattening of a top surface of individual substrates or compiled sets of substrates to deliver, for example, finished sets in the receiver tray that do not cause additional interference with later-delivered substrates or sets of substrates.

In conventional configurations, it is recognized by those of skill in the art that stapled sets build up on the stack below creating an increased thickness due to stapling that eventually builds to a point where an assembled stack of sets may interfere with the compiling of additional sets, causing unacceptable height differential and exacerbating difficulties introduced by individual substrate curl due to processing and environmental factors.

The disclosed embodiments introduce a pair of auger components that may be both the same, albeit in a mirrored configuration with opposite hand pitches. The disclosed auger components may be presented to the sides (for longer sheets), or at rear corners (for shorter sheets), of a compiling set of image receiving media substrates, to provide support for individual sheets of image receiving media substrates in a manner that may reduce and/or eliminate accumulating height differentials in a compiling tray. The disclosed embodiments are intended to reduce, or otherwise substantially eliminate, a tendency of an accumulated set or stack below to begin to curl upward due to an accumulation of individual substrate curl or a physical staple build-up.

Exemplary embodiments reduce these phenomena by removing a portion of a support underneath the substrates or stacks, allowing potentially elevated portions of the substrates or sets to sag, or to be forced, into a receiver portion in a compiler tray. Ultimately, mechanical force may be applied by a bottom operating surface of the auger components in a manner that the auger components may depress the upward curling substrates or upward building sets, compressing the protrusions in the substrates and/or stacks by pressing an upward edge down into the recessed receiver portion of the compiler tray. An objective of the disclosed subject matter, in addition to others, is to potentially allow more sets of image receiving media substrates to be compiled on a stack of such sets in the particularly-configured compiler tray.

In embodiments, as a set, or any portion thereof, is ejected from a compiler throat in any one or more image receiving media processing or post-processing devices, the disclosed auger components may turn in unison to lower the set down onto the accumulating stack below. In embodiments, completing one revolution of the pair of auger components may place the auger components in a position to support a next set of substrates.

In conventional configurations, it is recognized that an accumulated stack of sets of substrates below can begin to curl upward due to an accumulation of staple build-up. The disclosed embodiments may reduce the accumulated build-up removing a portion of the support in the compiler tray underneath effectively creating a structural gutter area that allows the stack to sag down. This physical modification to the compiler tray may, however, not account fully for the stack building up to an increasing level, and then curling upward. As the auger components, therefore, are caused to rotate to release a next set of substrates onto the stack, a lower surface of the auger components may depress the upward curling stack, removing accumulated air and pressing the edge down into the recessed area or structural gutter of the compiler tray. This forced interaction of the substrates with the mechanical components may allow more sets to be compiled on the stack.

Figure 3:
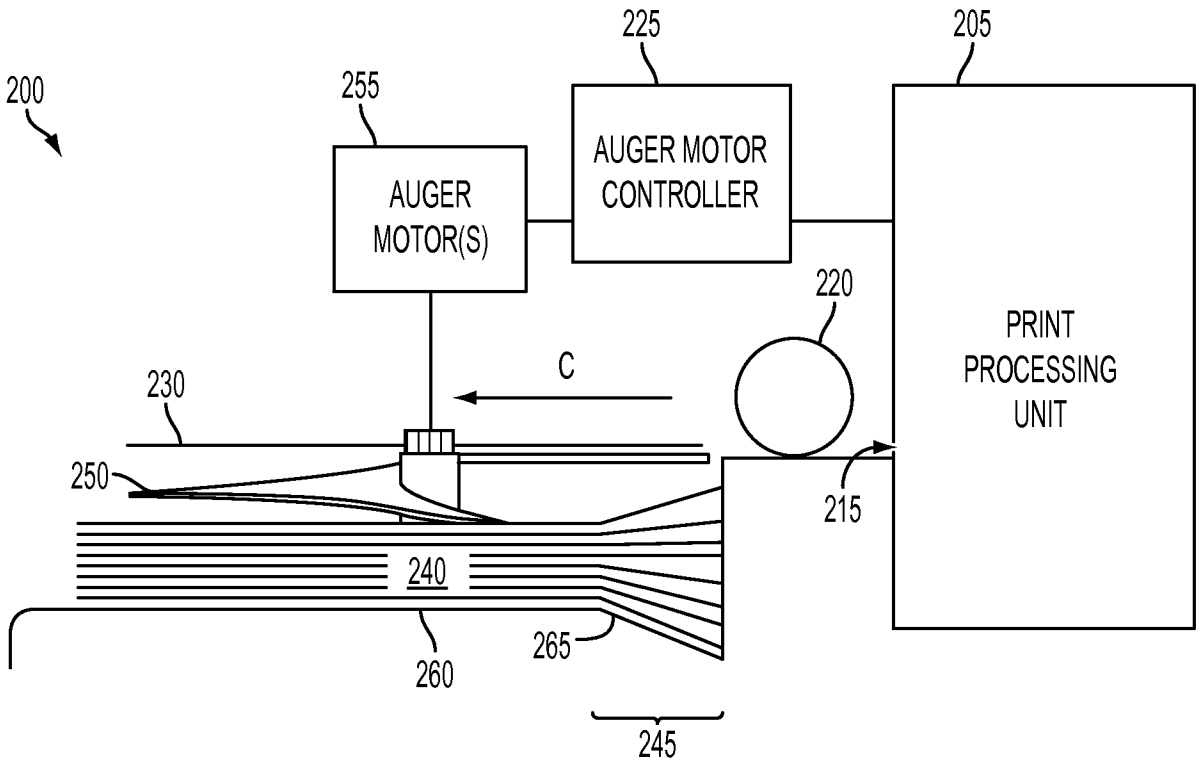
FIG. 3 illustrates a schematic diagram of a side view of an exemplary image receiving media processing and transport system incorporating a particularly-configured auger-based vertical compiler and a complementary configuration of a an image receiving media compiler tray at an output end of the vertical compiler executing a first functional step according to this disclosure.
Figure 4:
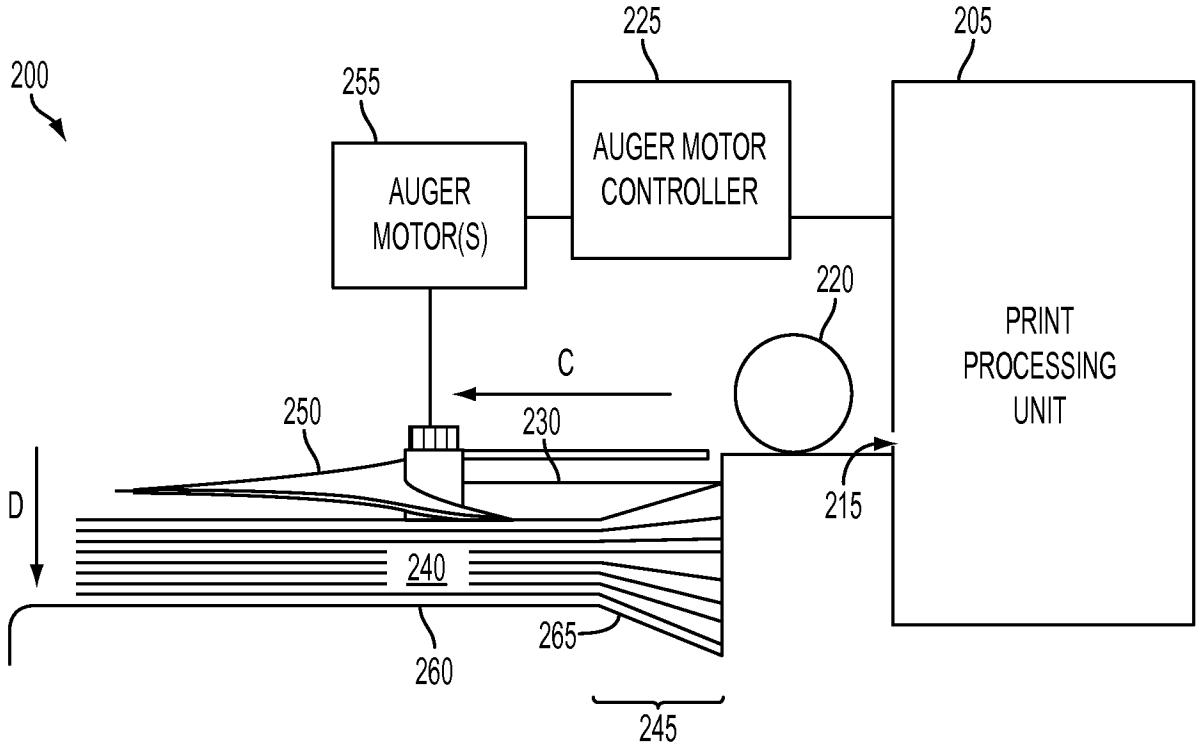
FIG. 4 illustrates a schematic diagram of a side view of the exemplary image receiving media processing and transport system of FIG. 3 executing a second functional step according to this disclosure.
Figure 5:
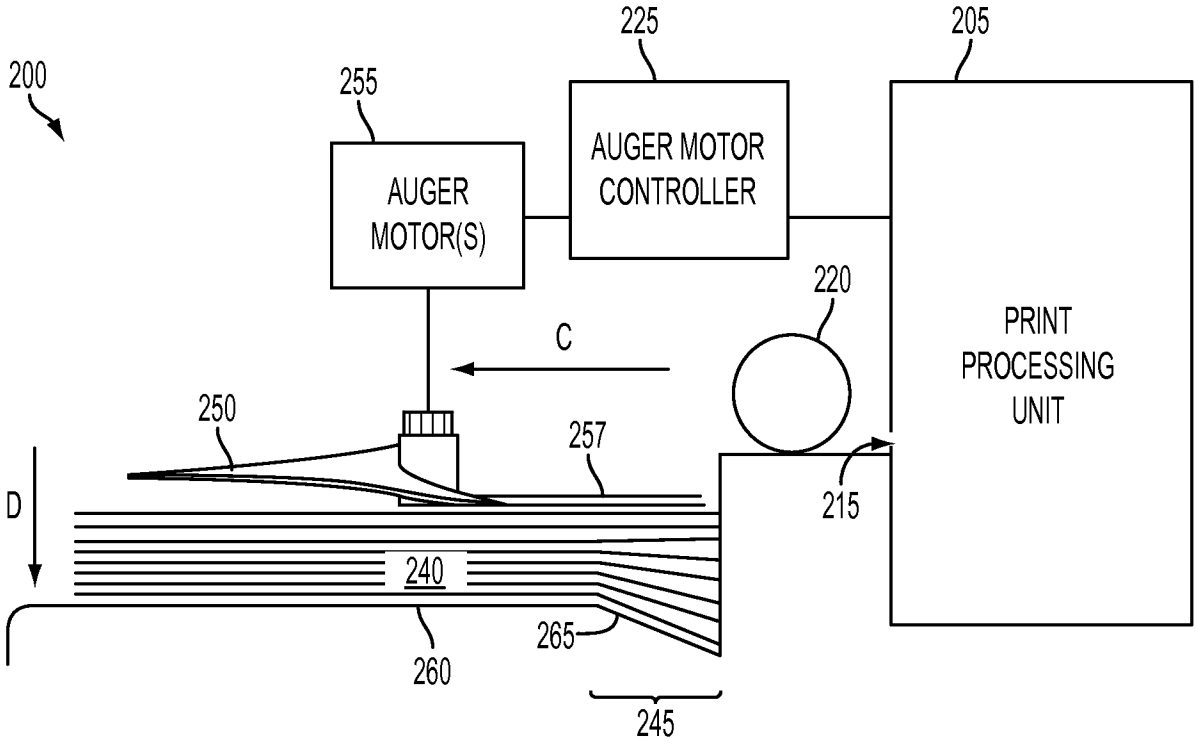
FIG. 5 illustrates a schematic diagram of a side view of the exemplary image receiving media processing and transport system of FIG. 3 executing a third and final functional step according to this disclosure.

FIG. 3 illustrates a schematic diagram of a side view of an exemplary image receiving media processing and transport system 200 incorporating a particularly-configured auger-based vertical compiler and a complementary configuration of an image receiving media compiler tray at an output end of the vertical compiler executing a first functional step according to this disclosure. FIGS. 4 and 5 illustrate schematic diagrams of a side view of the exemplary image receiving media processing and transport system of FIG. 3 executing second and third functional step according to this disclosure. As shown in FIG. 3, the exemplary system 200 may include one or more scuffers 220 that are generally arranged according to known methods to aid in the translation of an image receiving media substrate 230 from an ejector port or other similar opening 215 in a print processing unit 205. The generic print processing unit 205 is intended to represent, as appropriate, any one or more of a pre-conditioning device, marking module, post-processing device and/or other individual image receiving media substrate processing component, as may be associated with an image forming process in an image forming device or system. The scuffer 220 may be configured to induce movement of the image receiving media substrate 230 in the direction C, until the image receiving media substrate is clear of the ejector port or other similar opening 215 in the print processing unit 205. At the completion of the movement of the image receiving media substrate 230 induced by the scuffer 220, the image receiving media substrate 230 may be supported by a top surface of a pair of auger components 250.

The pair of auger components 250 may be formed of suitable materials including plastics and/or polycarbonates, and may include sleeve bearings at their ends, which may preferably be formed of bronze material. Pulley grooves, shown as vertical lines in the top of the depiction of the pair of auger components 250 in FIG. 3, may be molded into one end of a spindle of the pair of auger components 250 for engagement with, for example, one or more timing belts. Each of the auger components 250 may be mounted on a stainless pin attached to a sheet metal arm. A single auger motor 255, including a stepper motor, may be used to drive both of the pair of auger components 250 simultaneously. Otherwise in embodiments, multiple auger motors 255 may be used. Regardless of whether a single auger motor 255 or multiple auger motors are used, operation of the auger motor(s) 255 may be under control of an auger motor controller 225 that may be used to control one or more of the linear motion induced by the scuffer 220, and all aspects of image receiving media substrate set handling by the pair of auger components 250, as may be described in further detail below.

The pair of auger components 250 may be configured to provide support to the rear and side edges of individual substrates 230 or intermediately-accumulated sets of substrates, at substantially a same elevation as an exit from the scuffer 220. This configuration tends to remove a height differential, and/or to provide a consistent compiling height that allows improved set registration, for example, during one or more of tamping, stapling or other processing techniques.

FIG. 3 shows an accumulation 240 of substrates 230 previously vertically delivered and arranged on a compiler tray 260. The pair of auger components 250 may rotate 360 degrees to lower the substrates 230 and/or sets of substrates, ejecting the substrates 230 and/or sets of substrates for delivery onto the accumulation 240 below. At this same time then, the upper portion of the auger components 250 are cycled to a position ready for collecting additional substrates or sets of substrates.

The accumulation 240 (stack) below can build up a localized thickness due to staples or up-curl. Relieving the compiler tray 260 by providing one of a fixed or adjustable edge 265, including a ramped or stepped portion under the staples provides some relief, but eventually the build-up will begin to curl upward into a working area.

As shown in FIGS. 4 and 5, the pair of auger components 250 rotates to move the substrates or stacks lower. FIG. 5 shows that, as the pair of auger components 250 complete a revolution, trailing edges 257 of the pair of auger components 250 may contact the up-curl and compress the end portion 245 of the accumulation 240 downward into the relieved area provided by the adjustable edge 265 in the compiler tray 260, allowing more sets to be compiled before unload of the compiler tray 260 may be routinely required. In this manner, the disclosed cooperating configurations of the pair of auger components 250 (with training edges 257) and the compiler tray 260 (with the adjustable edge 265 forming a gutter) may, among other objectives, address difficulties in substrate handling that may be attributable to curling, stapling or other physical phenomena that may cause an end portion 245 of the accumulation 240 of substrates 230 to have a resultant higher vertical profile disadvantageously impinging into the working area.

It should be noted that the auger motor controller 225 may be a stand-alone component, or may be a part or function of another processor or controller logic device in the image forming device or system with which the exemplary image receiving media processing and transport system 200 may be associated. The auger motor controller 225 may, for example, receive input signals as a print job is processed in the image forming system to determine when and how much to rotate the pair of auger components 250 at different stages in the depicted image receiving media transport process to complete the overall image forming process in the image forming system with which the exemplary image receiving media processing and transport system 200 may be associated.

A vertical profile for the pitch of the auger components 250 downward to the depicted trailing edge surfaces 257 may not be particularly limited. The vertical profile for the pitch may be configured to accommodate individual sets of image receiving media substrates up to a particular maximum number of sheets or overall set thickness.

The above-described well-controlled vertical transport movements of individual image receiving media substrates and compiled sets of image receiving media substrates including vertical translation of the compiled sets of image receiving media substrates by the pair of auger components 250 of the depicted exemplary image receiving media processing and transport system 200 may aid in substantially reducing, and potentially eliminating, variations in in-set registration in the compiler tray 260. The disclosed systems seek to substantially preclude the registration variability incumbent in conventional compiler techniques. Positive control over both the support and transport movement of individual image receiving media substrates and compiled sets of image receiving media substrates aid in overcoming recognized shortfalls in conventional systems.

Figure 6:
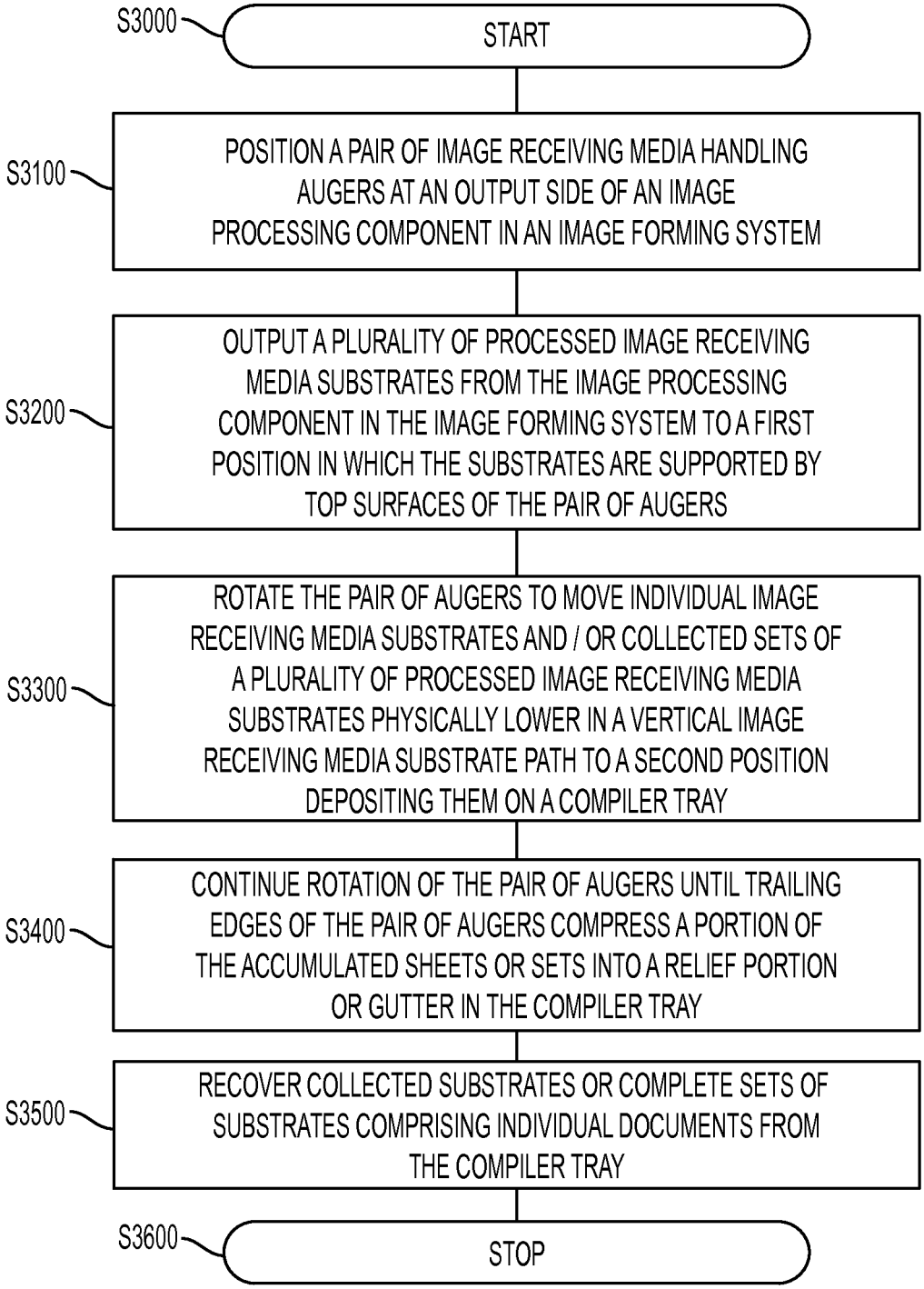
FIG. 6 illustrates a flowchart of an exemplary method for implementing a process for image receiving media transport of individual substrates or sets of substrates in a particularly-configured auger-based vertical compiler and cooperating compiler receiver tray sub-system according to this disclosure.

The disclosed embodiments may include a method for implementing a process for image receiving media transport of individual substrates or sets of substrates in a particularly-configured auger-based vertical compiler and cooperating compiler receiver tray sub-system. FIG. 6 illustrates a flowchart of such an exemplary method. As shown in FIG. 6, operation of the method commences at Step S3000 and proceeds to Step S3100.

In Step S3100, a pair of image receiving media handling auger components may be provided and/or arranged at an output side of an image processing or post-processing component or sub-system in the image forming system. The pair of image receiving media handling auger components may have trailing edge surfaces that are particularly configured to function according to the details of this disclosure. Operation of the method proceeds to Step S3200.

In Step S3200, a plurality of processed image receiving media substrates may be output in order from the image processing or post-processing component or sub-system in the image forming system to a first position in which the image receiving media substrates are supported by top surfaces of the pair of augers. Operation of the method proceeds to Step S3300.

In Step S3300, the pair of augers may be rotated to move individual processed image receiving media substrates or completed set of processed image receiving media substrates comprising single documents, according to a single print job assignment in the image forming system, from the first position in the image transport path for the image receiving media substrates lower to a second position depositing the individual processed image receiving media substrates or completed sets of processed image receiving media substrates comprising the single documents in a compiler tray. Operation of the method proceeds to Step S3400.

The disclosed compiler tray, as discussed above, may be specifically configured to have a separately fixed or movable relief component that may be in the form of a ramp or a step that may be usable to accommodate differing heights to portions of substrates or substrate sets due to being curled, stapled or otherwise processed.

In Step S3400, rotation of the pair of augers may be continued until trailing edges of the bottoms of the pair of augers are moved to compress a raised portion of the substrates or sets of substrates into the relief portion or gutter formed in the compiler tray. In this manner, more substrates or substrate sets may be accommodated in the compiler tray prior to requiring removal. Operation of the method proceeds to Step S3500.

In Step S3500, collected substrates or complete sets of substrates may be recovered from the compiler tray. Operation of the method proceeds to Step S3600, where operation of the method ceases.

The above-described exemplary systems and methods reference certain conventional components to provide a brief, general description of suitable document processing and post-processing means by which to carry out the disclosed image receiving media transport techniques in support of obtained image forming operations in the described image forming devices and systems. Those skilled in the art will appreciate that other embodiments of the disclosed subject matter may be practiced with many types and configurations of individual devices and combinations of devices particularly common to image forming and post-processing of image formed products in image forming devices and systems of varying complexity. No particular limitation to the variety or configuration of individual component devices included in image forming systems of varying complexity is to be inferred from the above description.

The exemplary depicted sequence of executable instructions represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 6, and the accompanying description, except where a particular method step is a necessary pre-condition to execution of any other method step. Individual method steps may be carried out in sequence or in parallel in simultaneous or near simultaneous timing, as appropriate.

Although the above description may contain specific details, they should not be construed as limiting the claims in any way. Other configurations of the described embodiments of the disclosed systems and methods are part of the scope of this disclosure.

It will be appreciated that a variety of the above-disclosed and other features and functions, or alternatives thereof, may be desirably combined into many other different systems or applications. Various alternatives, modifications, variations, or improvements therein may be subsequently made by those skilled in the art, which are also intended to be encompassed by the following claims.

We claim:

1. A method for handling image receiving media substrates in an image forming system, comprising:

providing a vertical compiler unit at an output of an image receiving media substrate processing device for vertically transporting individual processed image receiving media substrates or collected sets of processed image receiving media substrates, the vertical compiler unit comprising:

a pair of auger components as transport mechanisms in the vertical compiler unit, each of the pair of auger components having a helically extending vane with a trailing edge portion at a bottom of each of the pair of auger components, at least one auger motor for driving the pair of auger components in a coordinated manner about respective vertical auger component shafts for the pair of auger components, and an auger motor controller that controls movement of the vertical transport of the processed image receiving media substrates or collected sets of processed image receiving media substrates;

providing a compiler tray at an output of the vertical compiler unit, the compiler tray having a first portion that constitutes a substrate receiving surface and a second portion that constitutes a relief portion that is positioned vertically lower than the first portion;

driving the pair of auger components with the least one auger motor to vertically transport the individual processed image receiving media substrates or the collected sets of processed image receiving media substrates to be deposited on the compiler tray; and continuing the driving of the pair of auger components until the trailing edge portions apply a compressing force to vertically flatten protruding portions of an accumulation of image receiving media substrates into the second portion of the compiler tray.

2. The method of claim 1, the second portion of the compiler tray comprising a fixed relief portion.

3. The method of claim 1, the second portion of the compiler tray comprising a movable relief portion.

4. The method of claim 1, the second portion of the compiler tray comprising a stepped relief portion.

5. The method of claim 1, the second portion of the compiler tray comprising a ramp for the relief portion.

6. The method of claim 1, further comprising:

receiving, with the auger motor controller, signals regarding image processing in the image receiving media substrate processing device indicating completion of a set of processed image receiving media substrates collected on a top surface of the pair of auger components; and causing, with the auger motor controller, the at least one auger motor to operate to move the completed set of processed image receiving media substrates vertically downward to be deposited in the compiler tray, leaving the top surfaces of the pair of auger components open to receive another set of processed image receiving media substrates.

7. The method of claim 1, the pair of auger components being rotated by the at least one auger motor in opposing counter-rotating directions.

8. An image receiving media transport device, comprising:

a vertical compiler unit positioned at an output of an image receiving media substrate processing device for vertically transporting individual processed image receiving media substrates or collected sets of processed image receiving media substrates, the vertical compiler unit comprising:

a pair of auger components as transport mechanisms in the vertical compiler unit, each of the pair of auger components having a helically extending vane with a trailing edge portion at a bottom of each of the pair of auger components, at least one auger motor for driving the pair of auger components in a coordinated manner about respective vertical auger component shafts for the pair of auger components, and an auger motor controller that controls movement of the vertical transport of the processed image receiving media substrates or collected sets of processed image receiving media substrates; and a compiler tray positioned at an output of the vertical compiler unit, the compiler tray having a first portion that constitutes a substrate receiving surface and a second portion that constitutes a relief portion that is positioned vertically lower than the first portion, the pair of auger components being driven with the least one auger motor to vertically transport the individual processed image receiving media substrates or the collected sets of processed image receiving media substrates to be deposited on the compiler tray, the driving of the pair of auger components continuing until the trailing edge portions apply a compressing force to vertically flatten protruding portions of an accumulation of image receiving media substrates into the second portion of the compiler tray.

9. The device of claim 8, the second portion of the compiler tray comprising a fixed relief portion.

10. The device of claim 8, the second portion of the compiler tray comprising a movable relief portion.

11. The device of claim 8, the second portion of the compiler tray comprising a stepped relief portion.

12. The device of claim 8, the second portion of the compiler tray comprising a ramp for the relief portion.

13. The device of claim 8, the auger motor controller being programmed to:

receive signals regarding image processing in the image receiving media substrate processing device indicating completion of a set of processed image receiving media substrates collected on a top surface of the pair of auger components; and cause the at least one auger motor to operate to move the completed set of processed image receiving media substrates vertically downward to be deposited in the compiler tray, leaving the top surfaces of the pair of auger components open to receive another set of processed image receiving media substrates.

14. The device of claim 8, the pair of auger components being rotated by the at least one auger motor in opposing counter-rotating directions.

15. A system for processing image receiving media substrates, comprising:

at least one of an image receiving media substrate processing and post-processing device that executes one of substrate pre-processing, substrate conditioning, substrate marking, image fusing and document finishing;

a vertical compiler unit positioned at an output of the image receiving media substrate processing and post-processing device for vertically transporting individual processed image receiving media substrates or collected sets of processed image receiving media substrates, the vertical compiler unit comprising:

a pair of auger components as transport mechanisms in the vertical compiler unit, each of the pair of auger components having a helically extending vane with a trailing edge portion at a bottom of each of the pair of auger components, at least one auger motor for driving the pair of auger components in a coordinated manner about respective vertical auger component shafts for the pair of auger components, and an auger motor controller that controls movement of the vertical transport of the processed image receiving media substrates or collected sets of processed image receiving media substrates; and a compiler tray positioned at an output of the vertical compiler unit, the compiler tray having a first portion that constitutes a substrate receiving surface and a second portion that constitutes a relief portion that is positioned vertically lower than the first portion, the pair of auger components being driven with the least one auger motor to vertically transport the individual processed image receiving media substrates or the collected sets of processed image receiving media substrates to be deposited on the compiler tray, the driving of the pair of auger components continuing until the trailing edge portions apply a compressing force to vertically flatten protruding portions of an accumulation of image receiving media substrates into the second portion of the compiler tray.

16. The system of claim 15, the second portion of the compiler tray comprising a fixed relief portion.

17. The system of claim 15, the second portion of the compiler tray comprising a movable relief portion.

18. The system of claim 15, the second portion of the compiler tray comprising a stepped relief portion.

19. The system of claim 15, the second portion of the compiler tray comprising a ramp for the relief portion.

20. The system of claim 15, the auger motor controller being programmed to:

receive signals regarding image processing in the image receiving media substrate processing device indicating completion of a set of processed image receiving media substrates collected on a top surface of the pair of auger components; and cause the at least one auger motor to operate to move the completed set of processed image receiving media substrates vertically downward to be deposited in the compiler tray, leaving the top surfaces of the pair of auger components open to receive another set of processed image receiving media substrates.

* * * * *